United States Patent [19]

Middleton

[11] 4,015,553

[45] Apr. 5, 1977

[54] SUBMERSIBLE BARGE CONTROL SYSTEM

[75] Inventor: Frederic H. Middleton, Madison, Wis.

[73] Assignee: The United States of America as represented by the Secretary of the Navy, Washington, D.C.

[22] Filed: Aug. 18, 1975

[21] Appl. No.: 605,572

[52] U.S. Cl. ..... 114/16 E

[51] Int. Cl.[2] ..... B63G 8/00; B63G 8/26

[58] Field of Search ..... 114/16 E, 16 R, 16 A, 114/121

[56] References Cited

UNITED STATES PATENTS

| | | | |
|---|---|---|---|
| 1,964,383 | 6/1934 | Goodyear et al. | 244/84 |
| 2,887,977 | 5/1959 | Diry | 114/121 X |
| 3,020,002 | 2/1962 | Frost | 244/23 C |
| 3,131,664 | 5/1964 | McInvale | 114/16 R |
| 3,713,411 | 1/1973 | Bordessoule et al. | 114/16 E |
| 3,742,885 | 7/1973 | Strickland | 114/16 A |

*Primary Examiner*—Trygve M. Blix
*Assistant Examiner*—Gregory W. O'Connor
*Attorney, Agent, or Firm*—Richard S. Sciascia; Ervin F. Johnston

[57] ABSTRACT

A control system for a submersible barge wherein an operator can control the movements of the barge by pushing joy sticks in various directions which correspond psychologically with the desired movements. The barge has a ballast tank located in each of its lateral quadrants along with a system for independently ballasting or deballasting any one of the tanks. The mounting of the joy sticks on the barge and the configuration of the ballasting and deballasting system are such that the operator can control the barge in pitch or roll in regard to any one of the barges longitudinal or diagonal axes.

10 Claims, 12 Drawing Figures

BL = BLOW
FL = FLOOD
S = STERN
B = BOW

SUBMERSIBLE BARGE CONTROL SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The U.S. Navy has undertaken a sizeable research and development program of small manned submersible vehicles for performing exploratory an salvage functions in the oceans. Historically, these small submersibles have been launched and retrieved by a surface ship. This is difficult to accomplish because of the normal wave action around the ship. In order to overcome this problem, the Navy developed a submersible barge which can be towed by the ship for the launching and recovery of the submersible vehicle. When the barge is towed at a depth of about 40 feet the wave action is considerably less, and the submersible vehicle can easily take off and land on the submerged barge.

The prior development of this barge included separate manipulative controls for each ballast tank and for each of the flooding or blowing functions. The control of such a barge is not psychologically practical for a diver to operate since the operation requires knowledge of the complexities of the ballast tank locations, control locations, and control functions. Only by being intimately aware of the barges layout and design could an operator control the barge safely and effectively.

SUMMARY OF THE INVENTION

The present invention provides a barge with a control system which enables an operator to employ his psychological instincts to manipulate the barge without consciously thinking which control operates which ballast tank and what function will be performed. The barge is provided with ballast tank in each of its quadrants. Further, port and starboard joy sticks are provided, the port joy stick controlling the ballast tanks on the port side and the starboard joy stick controlling the ballast tanks on the starboard side. Essentially, the barge will pitch or roll in any direction in which the joy sticks are pushed by the operator. Further, the ballast tanks flood when the joy sticks are pushed outwardly and are blown when the joy sticks are pushed inwardly, thus accomplishing from the natural inward movements the security of raising the barge from a submerged position. The quadrant ballasting and deballasting control along the positions of the joy sticks and the interconnections of the controls enable a unique and simple operation of the submerged barge which has not been obtainable heretofore.

The invention may further include a second set of smaller ballast tanks mounted in quadrant locations above the first set along with a second pair of joy sticks for controlling these smaller tanks. The controls and the smaller tanks enable the operator to trim and effectively drive the barge while in the submerged condition.

In a broad aspect the invention can be considered as providing quadrant control for any platform where it is desired that there be response which corresponds to the normal psychological movements of the controls.

OBJECTS OF THE INVENTION

An object of the present invention is to provide a platform with quadrant control, which platform can be moved by the natural psychological manipulative movements of the controls by an operator.

Another object is to provide a submersible barge which can be moved in roll or pitch about its longitudinal or diagonal axes by natural instinctive controlling movements of an operator.

A further object is to provide the advantages of the immediately previous object, but in addition to ascend or descend the barge by the natural instinctive controlling movements of an operator.

Still another object is to provide the advantages of the immediately previous object, but in addition to enable an operator to manipulate a dual set of controls for the same types of movements except one set of controls being for major movements of the barge and the other set of controls being for minor movements of the barge.

These and other objects of the invention will become more readily apparent from the ensuing specification when taken together with the drawings.

DESCRIPTION OF THE PREFERRED EMBODIMENTS

Figure 1:
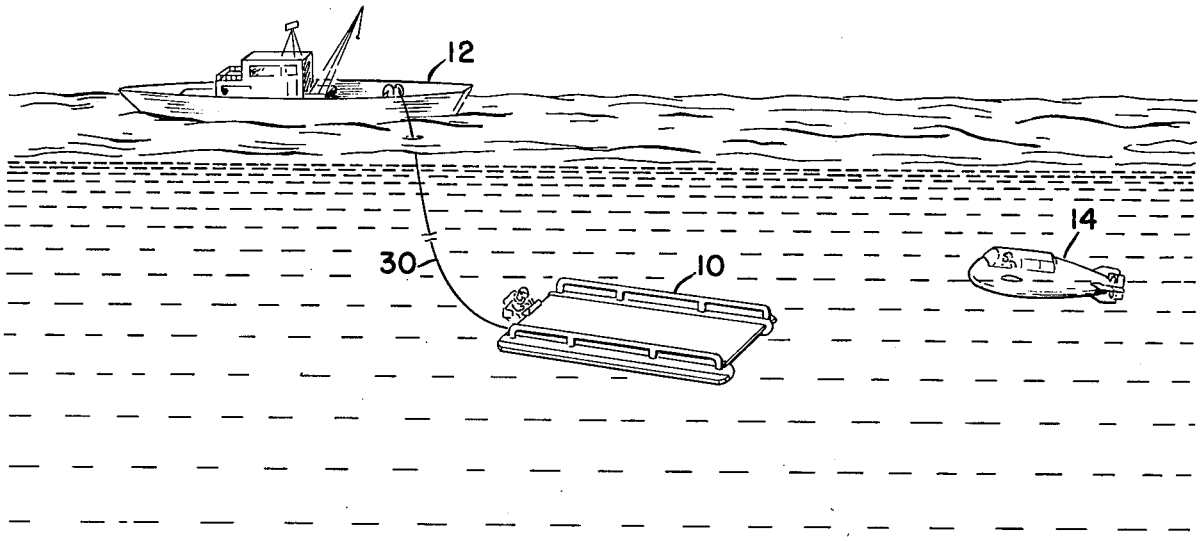
FIG. 1 is an ocean elevation view of the submerisble barge in tow and in the process of receiving an underwater vehicle.

Referring now to the drawings wherein like reference numerals designate like or similar parts throughout the several views, there is illustrated in FIG. 1 a submersible barge 10 which is being towed in a submerged condition by a surface vessel 12. A diver is seated at the bow end of the barge, and is positioning the barge for the submerged landing of an underwater vehicle 14. In positioning the barge the diver is utilizing various control handles and system which will be described in detail hereinafter.

Figure 2:
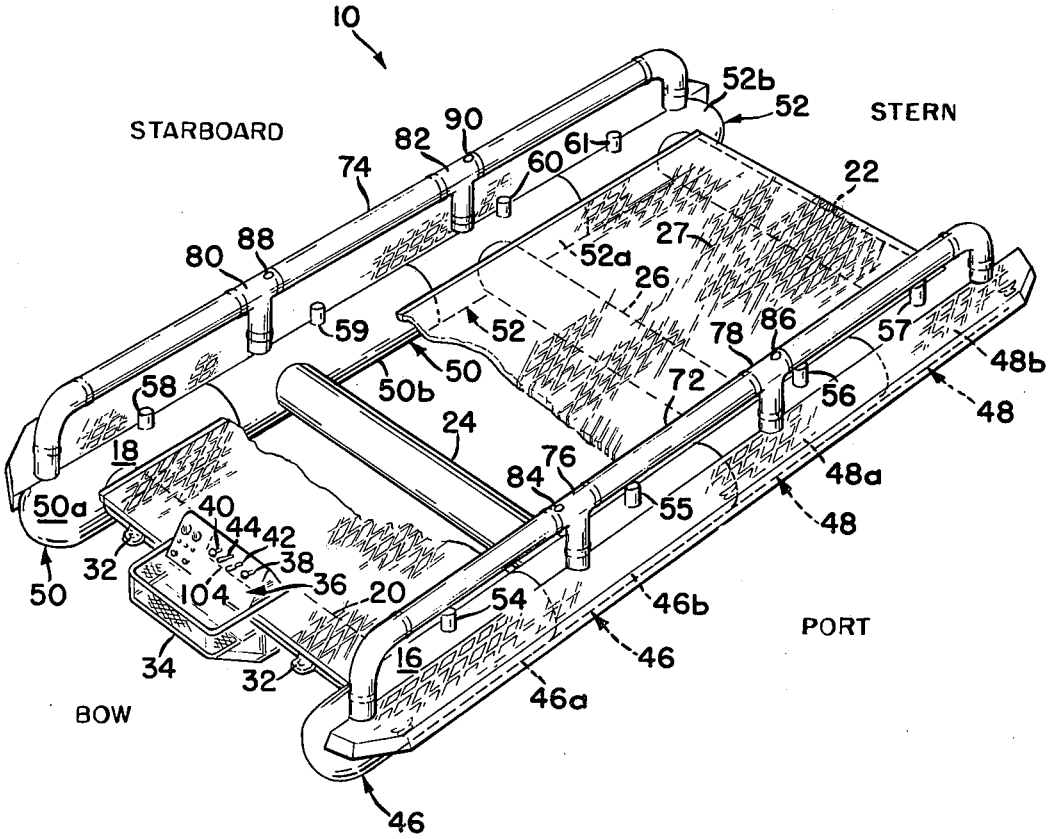
FIG. 2 is a top isometric view of the submersible barge.

Referring now to FIG. 2, the submersible barge 10 is illustrated in isometric form. The submersible barge 10 may include a pair of port and starboard pontoons 16 and 18 which are spaced apart by cross tubes. The bow and stern cross tubes, 20 and 22 may be utilized to provide accumulators, and the middle cross tubes 24 and 26 may be utilized to provide high pressure air supplies for a ballasting and deballasting system which will be described in detail hereinafter.

A steel lattice platform 27 may be mounted on the cross tubes 20, 22, 24, and 26 for enabling water to pass freely as the barge ascends or descends, and yet be capable of supporting the weight of the underwater vehicle 14. The barge 10 is towed in a surfaced or submerged position by a tow cable 30 which may be attached to the barge at a pair of cleats 32. At the bow end of the barge there is mounted a seat 34 for one or two divers so that they face in an aft direction for positioning the barge for the departure or return of the underwater vehicle as the barge is being towed by the surface craft. Mounted in front of the divers is a control panel 36 which has all of the controls, including joy sticks 38, 40, 42 and 44, for ballasting and deballasting the barge to obtain desired positions and movements of the barge in the water.

Figure 9A:
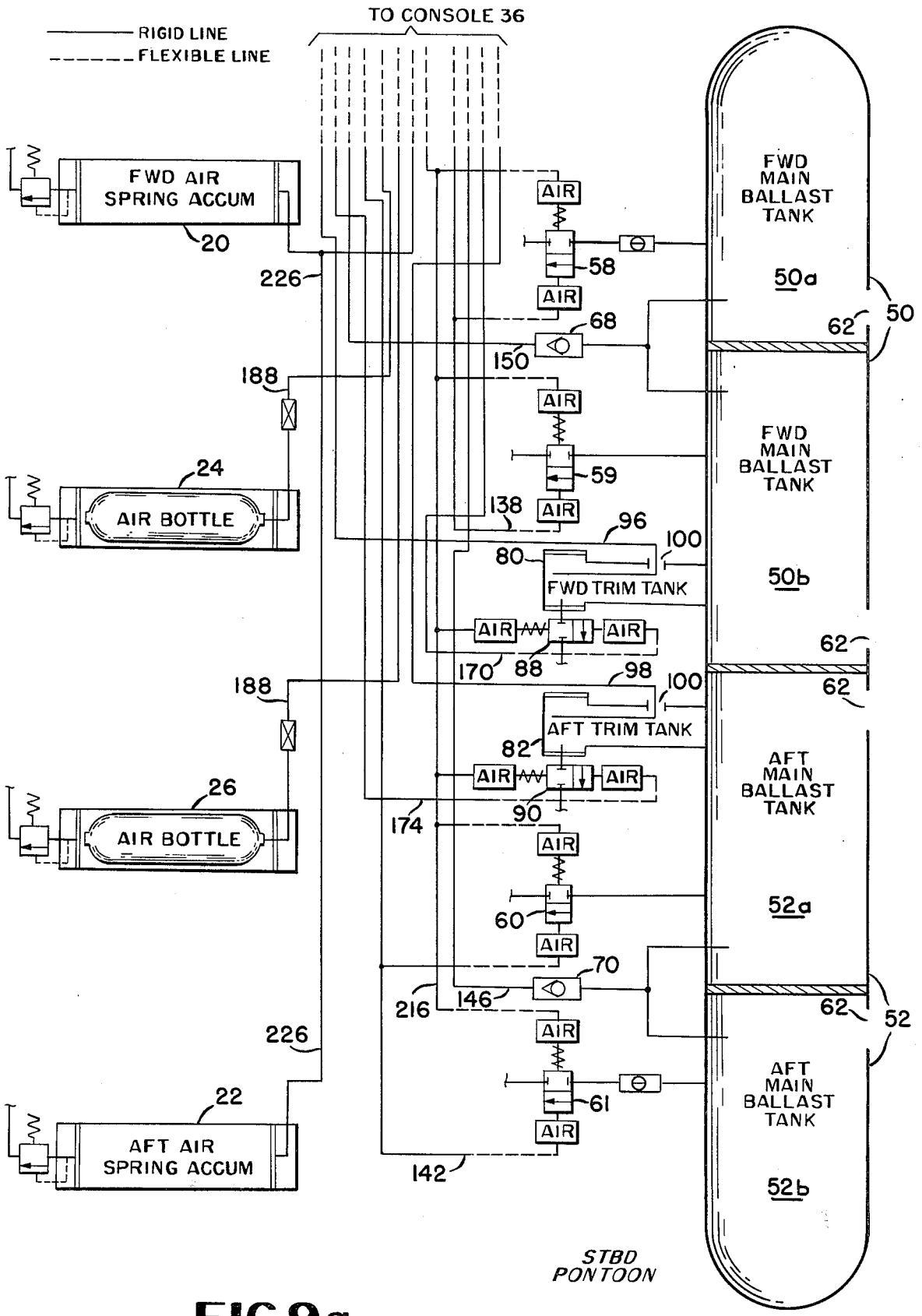
FIGS. 9*a*, 9*b*, 9*c*, and 9*d* are schematic illustrations of the control system for the submersible barge.
Figure 9B:
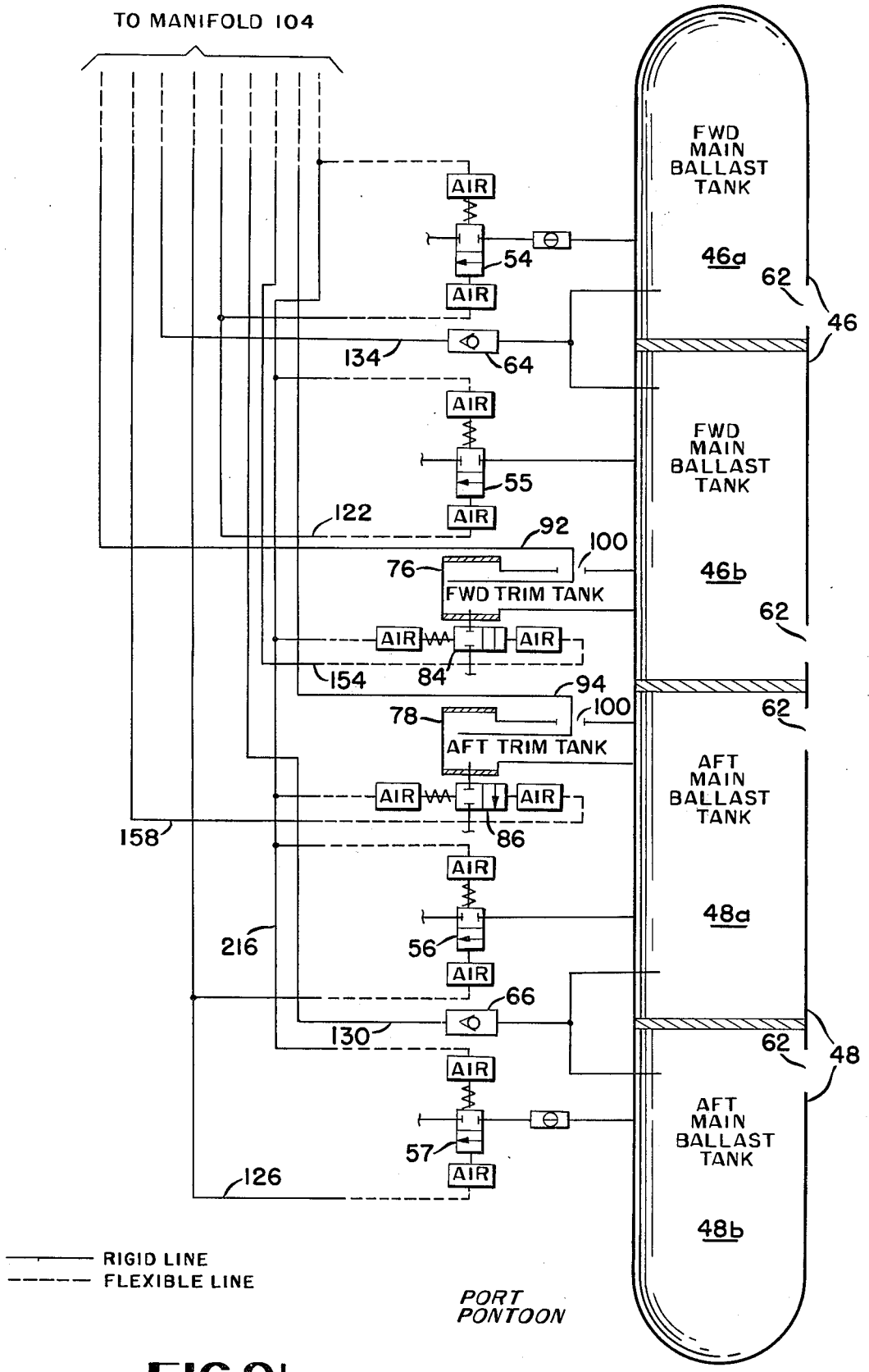
Figure 9D:
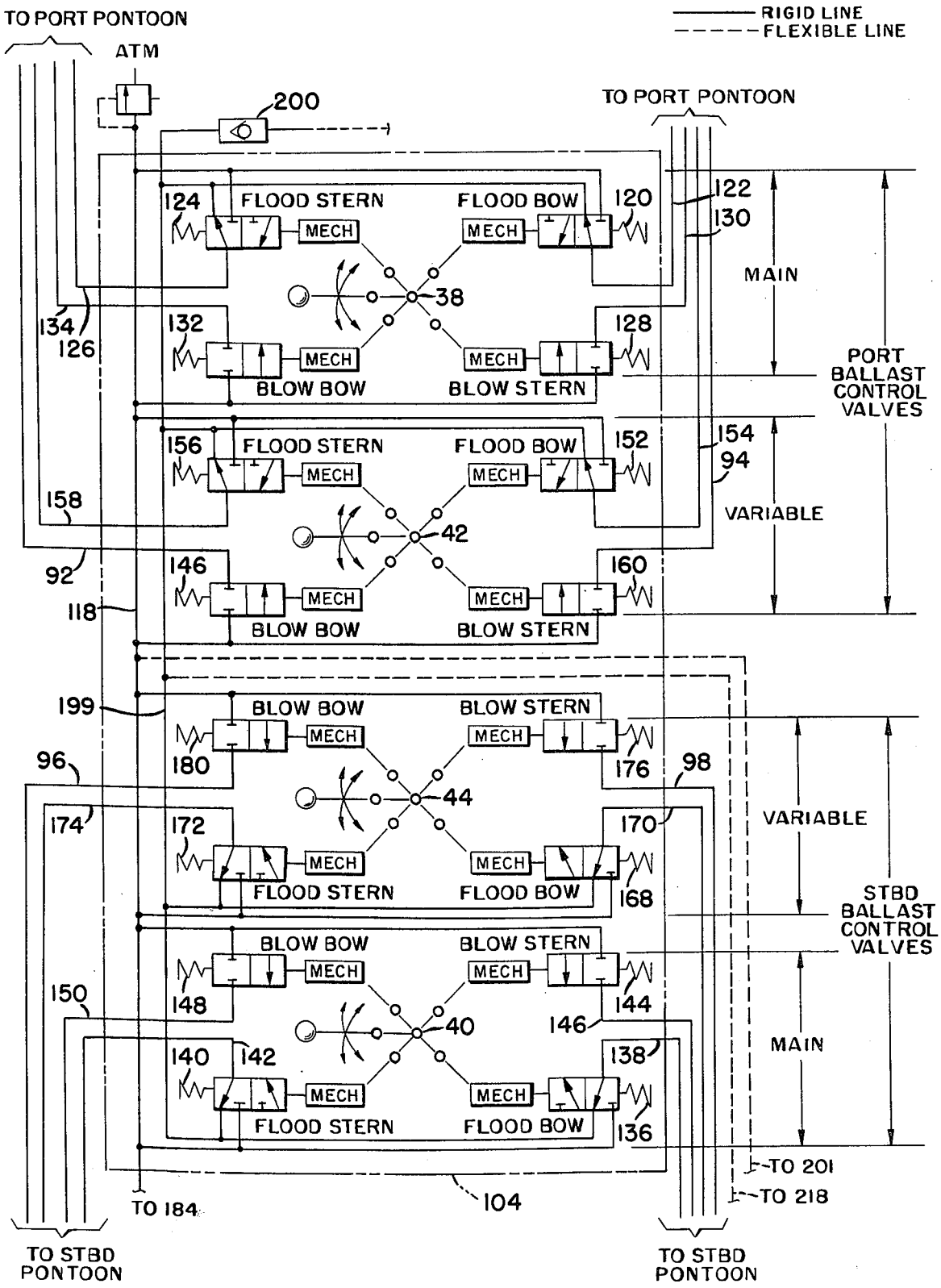

In order to provide the desired ballasting and deballasting of the submersible barge 10 the port pontoon 16 may be divided into forward and stern ballast tanks 46 and 48, and the starboard pontoon 18 may be divided into forward and stern ballast tanks 50 and 52. Because of the size of these tanks they may be further divided down so that the forward tanks 46 and 50 are evenly divided into tanks 46*a*, 46*b*, 50*a* and 50*b*, and in a like manner the stern tanks 48 and 52 may be evenly divided into tanks 48*a*, 48*b*, 52*a*, and 52*b*. As illustrated in FIGS. 2 and 9*a*–9*d*, flood valves 54, 55, 56, 57, 58, 59, 60, and 61 may be provided for the selective flooding of the tanks 46*a*, 46*b*, 48*a*, 48*b*, 50*a*, 50*b*, 52*a*, and 52*b* respectively. As schematically illustrated in FIGS. 9*a* and 9*b*, water will enter these tanks through bottom openings 62. Also as illustrated by FIGS. 9*a* and 9*b*, these same tanks may be blown and deballasted through valves 64, 66, 68, and 70 respectively by pairs. The ballast tanks 46, 48, 50, and 52 comprise the main ballast tanks and are primarily utilized for major control functions of ascending or descending within the water. These tanks are controlled by the port and starboard joy sticks 38 and 40, the port joy stick 38 selectively controlling the independent flooding or blowing of the port ballast tanks 46 and 48, and the starboard joy stick 40 selectively controlling the independent flooding or blowing of the starboard ballast tanks 50 and 52.

As illustrated in FIG. 1, the submersible barge 10 may be further provided with port and starboard railings 72 and 74 which may be mounted on and extend above the respective pontoons 16 and 18. Intermediate the port railing there may be provided a pair of forward and aft trim ballast tanks 76 and 78 respectively, and the starboard railing may be provided in a similar manner with forward and aft trim ballast tanks 80 and 82 respectively. The railing portions which extend between and from these trim ballast tanks may be sealed with an air volume so as to provide the desired fixed buoyancy. As illustrated in FIGS. 9*a* and 9*b*, the forward and aft port trim ballast tanks 76 and 78 are independently and selectively flooded through flood valves 84 and 86 respectively, and the forward and aft trim ballast tanks 80 and 82 are selectively and independently flooded by flood valves 88 and 90 respectively. These same tanks may be provided with blow lines 92, 94, 96, and 98 respectively for selectively and independently deballasting these tanks. The trim tanks may be provided with side openings 100 through which the blow lines 92, 94, 96, and 98 may extend. The port and starboard joy sticks 42 and 44, as shown in FIG. 2, may be utilized for selectively and independently controlling the flooding or blowing of the port trim tanks 76 and 78 and the starboard trim tanks 80 and 82 respectively in the same manner as the control of the main ballast tanks 46, 48, 50, and 52 by the joy sticks 38 and 40 described hereinabove.

With the arrangement described above, the submersible barge 10 has four separate main ballast tanks which are located one in each lateral quadrant of the barge. The ballast tank 46 is located in the port bow quadrant, the tank 48 is located in the port stern quadrant, the tank 50 is located in the starboard bow quadrant, and the tank 52 is located in the starboard stern quadrant. These tanks are controlled by the handles or joy sticks 38 and 40, the joy stick 38 being located on a port side of the barge for controlling the port ballast tanks 46 and 48, and the joy stick 40 being located on the starboard side of the barge for controlling the starboard ballast tanks 50 and 52. The joy sticks 42 and 44 operate the trim ballast tanks 76, 78, 80, and 82 in the same manner.

A significant feature of the invention is that the diver is able to control the barge in its movements by psychologically natural manipulative operation of the joy sticks 38 and 40. The same applies to the control of the barge for lesser trim movements through use of the joy sticks 42 and 44. The joy sticks 38 and 40 are part of an actuating means, which will be described in detail hereinafter, which enables the diver to roll and pitch the barge with regard to longitudinal, and diagonal axes by natural movements of the joy sticks 38 and 40, as well as ascending or descending the barge as desired. Again, the same can be accomplished with joy sticks 42 and 44, but to a lesser degree.

Figure 7:
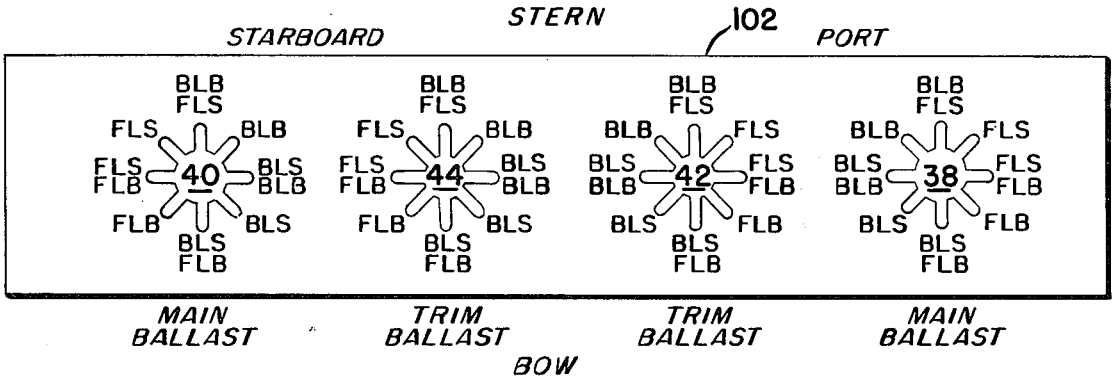
FIG. 7 is a view of panel plate taken along plane VII—VII of FIG. 3.
Figure 6:
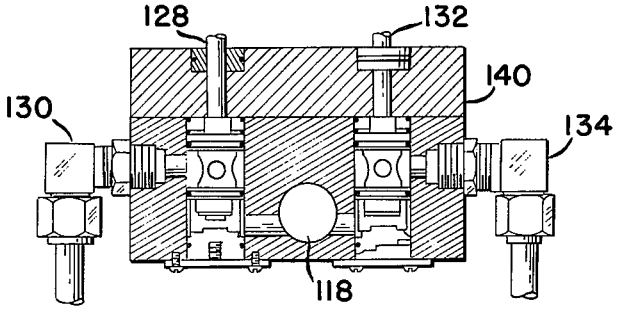
FIG. 6 is a cross sectional view taken along plane VI—VI of FIG. 3.

As illustrated in FIG. 7, the joy sticks 38 and 40 are each provided with eight degrees of freedom, namely, in the following directions: bow, stern, port, starboard, and diagonal directions therebetween. These directional movements of the joy sticks 38 and 40 may be provided by a panel plate 102 which has slots about each respective joy stick in the directions just mentioned. The actuating means, which will be described in detail hereinafter, enables the diver to pitch the barge downwardly in any one of the eight directions in which the respective joy stick is pushed.

As stated hereinabove, the port joy stick 38 controls just the port ballast tanks 46 and 48 and the starboard joy stick 40 controls just the starboard ballast tanks 50 and 52. A diagonal movement of either of the joy sticks 38 and 40 controls individually only one of the ballast tanks in a flood or blow mode; and a bow, stern, port or starboard movement blows and/or floods both of the tanks on a respective side of the barge depending upon which direction the joy stick is moved. If the joy stick is moved in an outboard athwartships or one of the outboard diagonal directions a flooding mode is established and if the joy sticks are moved in an inboard athwartships or one of the inboard diagonal directions a blowing mode is established. If the joy sticks are moved in a forward or stern direction a combination of blowing and flooding of the tanks takes place. The inboard and outboard movements of the joy sticks establish a response by the barge which corresponds to the natural instinctive arm movements of a human. When the operator pulls the controls inwardly the barge will ascend to safety, and when the operator pushes the controls outwardly the barge will descend.

Specifically, as illustrated in FIGS. 2 and 7, the port joy stick 38 will flood the port bow ballast tank 46 when pushed in the port bow diagonal direction, flood the port stern ballast tank 48 when pushed in the port stern diagonal direction, blow the port bow ballast tank 46 when pushed in the starboard stern diagonal direction and blow the port stern ballast tank 48 when pushed in the starboard bow diagonal direction. Any one of these movements causes a pitching or dipping of the barge in the direction in which the joy stick is pushed. The operation of the joy stick 40 is identical except that it controls the starboard ballast tanks 50 and 52 in a like manner.

When the port joy stick 38 is pushed in a bow direction it will flood the port bow ballast tank 46 simultaneously with the blowing of the port stern ballast tank 48. When the port joy stick 38 is pushed in the stern direction it will cause a blowing of the port bow ballast tank 46 simultaneously with a flooding of the port stern ballast tank 48. When the port joy stick 38 is pushed in an outboard athwartships or port direction it will cause a simultaneous flooding of both of the port bow and port stern ballast tanks 46 and 48. When the joy stick is pushed in an inboard athwartships or starboard direction it will cause a simultaneous blowing of both of the port bow and port stern ballast tanks 46 and 48. The joy stick 40 operates in an identical manner as the joy stick 38 except that it controls the starboard ballast tanks 50 and 52.

In a broad concept of the invention the joy sticks 38 and 40 may be operable only in the diagonal directions for independently controlling the respective ballast tanks, however, in the preferred embodiment the additional four degrees of control in the bow, stern, port, and starboard directions are desired.

As stated hereinabove, trim ballast tanks 76, 78, 80, and 82, which are of a smaller volume than the main ballast taks 46, 48, 50, and 52, are provided for slight movements of the barge while in the submerged condition. These trim tanks are located in respective lateral quadrants of the barge in a like manner, as the main ballast tanks, the trim tank 76 being located in the port bow quadrant, the tank 78 being located in the port stern quadrant, the tank 80 being located in the starboard bow quadrant, and the tank 82 being located in the starboard stern quadrant. The joy sticks 42 and 44 are utilized for selective flooding and blowing of these trim tanks, the port joy stick 42 controlling only the port trim tanks 76 and 78, and the starboard joy stick 44 controlling only the starboard trim tanks 80 and 82.

The joy sticks 42 and 44 control their respective trim tanks 76, 78, 80, and 82 in an identical pattern and manner just described for the control of the main ballast tanks 46, 48, 50, and 52 by the joy sticks 38 and 40. As illustrated in FIG. 7, the panel plate 102 is provided with slots so that each of the joy sticks 42 and 44 have eight degrees of freedom in the blow, stern, port, and starboard directions, and all diagonal directions therebetween. When either of the joy sticks 42 or 44 is moved outwardly, diagonally or straight, it will flood a tank or combination of tanks, and when moved inwardly, diagonally or straight, it will blow a trim tank or combination of trim tanks. When either of the joy sticks 42 or 44 is moved in a bow or stern direction it will blow and flood simultaneously a combination of trim tanks. Accordingly, the same natural instinctive movements of the joy sticks 38 and 40, described hereinabove, can be applied to the operation of the joy sticks 42 and 44.

It should be noted that the joy sticks 38, 40, 42 and 44 are in an aligned athwartships direction with the main ballast tank joy sticks 38 and 40 being located outboard of the trim tank joy sticks 42 and 44. This positioning establishes the natural instinctive human response to operate the inboard controls for fine or slight control of the barge as contrasted to operation of the outboard controls for large and major controls of the barge. The top handle portions of the joy sticks may also be different so that the main ballast joy sticks 38 and 40 have different handles from the inboard trim joy sticks 42 and 44, as illustrated in FIG. 3.

Figure 3:
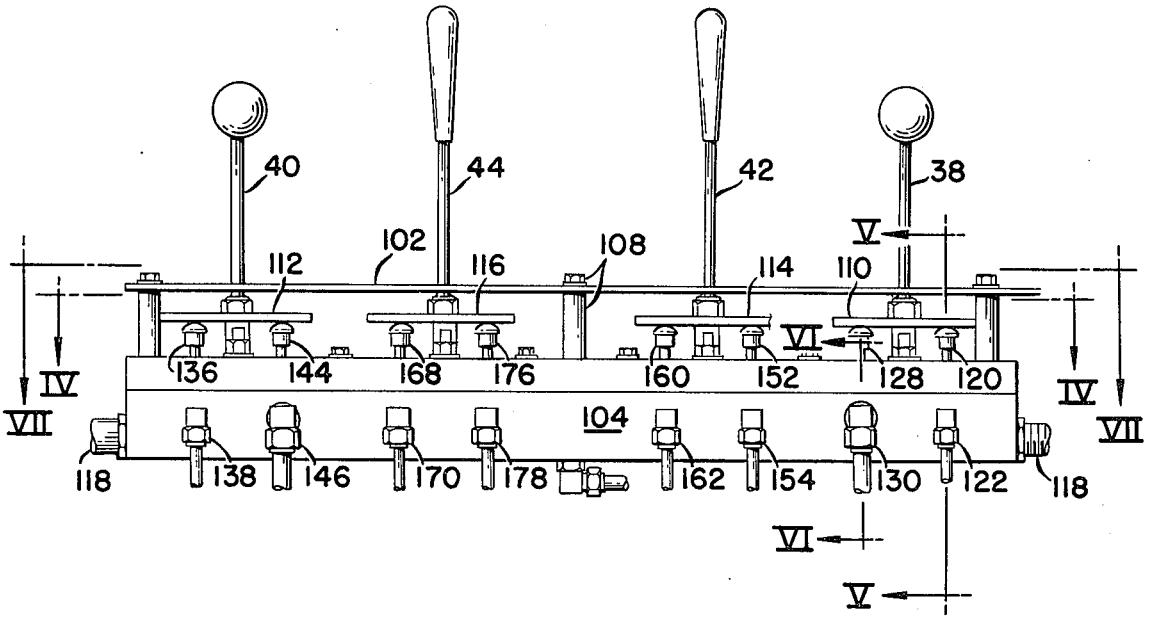
FIG. 3 is a side view of the operator's control panel for the submersible barge.
Figure 5:
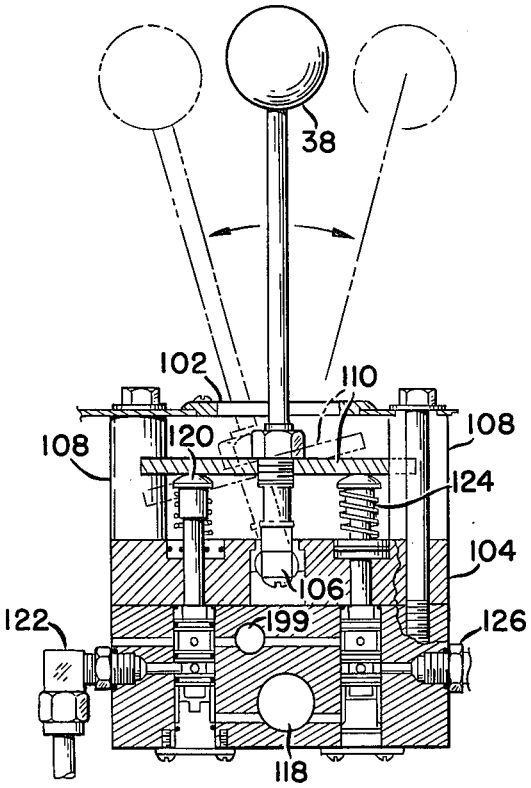
FIG. 5 is a cross sectional view taken along plane V—V of FIG. 3.

As illustrated in FIGS. 3 and 5 the joy sticks 38, 40, 42, and 44 may each be pivotably mounted in a manifold block 104 by ball and socket joints 106. The panel plate 102, of FIG. 7 may be mounted across the top of the manifold block 104 by bolt and spacer combinations 108. The joy sticks 38, 40, 42, and 44 may be provided with lateral swash plates 110, 112, 114, and 116 respectively for selective operation of valves which will be described in detail hereinbelow. The manifold block 104 is provided with a central passgeway 118 for supplying pressurized air to each of the valves and with passageways from each of the valves to respective fittings and conduits for carrying out the flooding and blowing of the tanks as described hereinabove.

Figure 4:
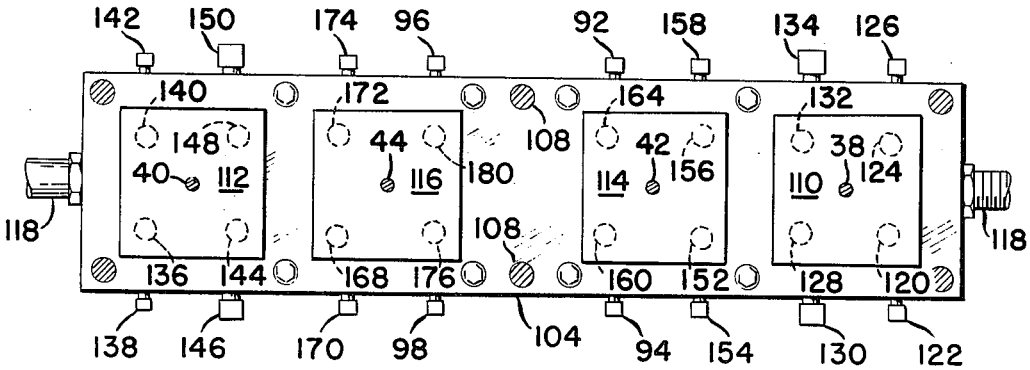
FIG. 4 is a cross sectional view taken along plane IV—IV of FIG. 3.

As illustrated in FIGS. 3 and 4, each joy stick is provided with four push button valves immediately below its respective swash plate. The valves are located along the diagonal directions from the respective ball and socket joint between the bow, stern, port, and starboard directions. The outboard pair of valves within each set are the flood valves which are three way normally closed push button type valves, and the inboard pair of valves in each set are the blow valves which are push button normally closed type of valves.

Referring again to FIG. 4, the joy stick 38 has a flood valve 120 located in a port bow direction for flooding, via a conduit 122, the port bow ballast tank 46, and a flood valve 124 located in the port stern direction for flooding, via a conduit 126, the port stern ballast tank 48. The joy stick 38 further has a blow valve 128 located in a starboard bow direction for blowing, via conduit 130, the port stern main ballast tank 48; and a valve 132 in the starboard stern direction for blowing, via a conduit 134, the port bow main ballast tank 46.

The starboard main ballast joy stick 40 has a flood valve 136 in the starboard bow direction for flooding, via conduit 138, the starboard bow main ballast tank 50, and a flood valve 140 in a starboard stern direction for flooding, via a conduit 142 the starboard stern main ballast tank 52. The joy stick 40 further has a blow valve 144 in its port bow direction for blowing, via a conduit 146, the starboard stern main ballast tank 52; and a blow valve 148 in its port stern direction for blowing, via a conduit 150, the starboard bow main ballast tank 50.

The port trim joy stick 42 is provided with a flood valve 152 in its port bow direction for flooding, via a conduit 154, the port bow trim tank 76; and a flood valve 156 located in a port stern direction for flooding, via a conduit 158, the port stern trim tank 78. The joy stick 42 is further provided with a blow valve 160 which is located in the starbord bow direction for blowing, via the conduit 94, the pot stern trim tank 78; and a valve 164 located in a starboard stern direction for blowing, via the conduit 92, the port bow trim ballast tank 76.

The starboard trim joy stick 44 is provided with a flood valve 168 located in the starboard bow direction for flooding via a conduit 170 the starboard bow trim tank 80, and a valve 172 located in a starboard stern direction for flooding via a conduit 174 the starboard stern trim tank 82. Joy stick 44 is further provided with a blow valve 176 in a port bow direction for blowing via the conduit 98 the starboard stern trim tank 82, and a blow valve 180 located in a port stern direction for blowing via the conduit 98 the starboard bow trim ballast tank 82.

With the quadrant locations of the various flood and flow valves in the manifold 104, it can now readily be understood that the swash plates 110, 112, 114, and 116, play a very novel and unique function in joy stick control to obtain selective ballasting of the main ballast tanks 46, 48, 50, and 52, and the trim ballast tanks 76, 78, 80, and 82. When any one of the joy sticks is pushed in any one of the diagonal directions between the bow, stern, port, and starboard directions only one valve will be pushed and opened for either flooding or blowing a single tank. However, if any one of the joy sticks is pushed in a bow, stern, port, or starboard direction a pair of valves is pushed and opened by the respective swash plate so that a combination of flooding and/or blowing of selected tanks is accomplished. This unique combination enables the diver to pitch or roll the barge about any one of the longitudinal or diagonal axes or quickly deballast or ballast the tanks for ascending or descending functions of the barge.

The interconnections of the flood and blow valves, the various conduits or tubing, and the ballast tanks are illustrated schematically in FIGS. 9*a*, 9*b*, 9*c*, and 9*d*. The diver's console 36 includes the manifold 104 (see FIG. 9*d*) with the various joy sticks and flood and flow valves, as well as various pressure gauges, regulator valves, and relief valves (see FIG. 9*c*). The main supply air pressure is provided by conduit 118 (see FIG. 9*d*) which is connected to each of the flood and blow valves in the manifold 104. It is this pressure, which is reduced from a high pressure source 24 and 26, (see FIG. 9*a*), which is applied to the various ballast tanks for the flooding or blowing functions.

The air pressure in the conduit 118 is reduced by a main pressure regulator 184 (see FIG. 9*c*) which in turn is regulated in its pressure by a pilot regulator 186. A suitable regulator pressure has been found to be 125 psi. The main pressure regulator 184 receives its high pressure air from aline 188 which is split at a tee connection 190 for ultimate connection to the high pressure air bottles 24 and 26. The air bottles 24 and 26 may be provided with an original air pressure of approximately 2200 psi. Each portion of the high pressure line 188 upstream from the tee connection 190 is provided with a respective pressure gauge 192 and 194 for indicating the air pressure of bottles 24 and 26 respectively, and charging valves 196 and 198 for charging the bottles 24 and 26 respectively with high pressure air. Since it is undesirable to trap air within the flood and blow valves during an ascent phase of the barge, all of the flood valves are interconnected to an exhaust conduit or passageway 199 for venting these valves through a check valve 200 when these valves are closed. A gauge 201 (see FIG. 9*c*) will indicate the venting pressure. This venting is required because the push button flood valves 120, 124, 136, 140, 152, 156, 168, and 172 operate in conjunction with ballast flood valves 54, 55, 56, 57, 58, 59, 60, 61, 84, 86, 88, and 90 which establish a closed system. The ballast flood valves, which are air spring valves, will be described in detail hereinbelow. The blow valves are automatically vented as the barge ascends since they are open ended into the respective ballast tanks.

Figure 8:
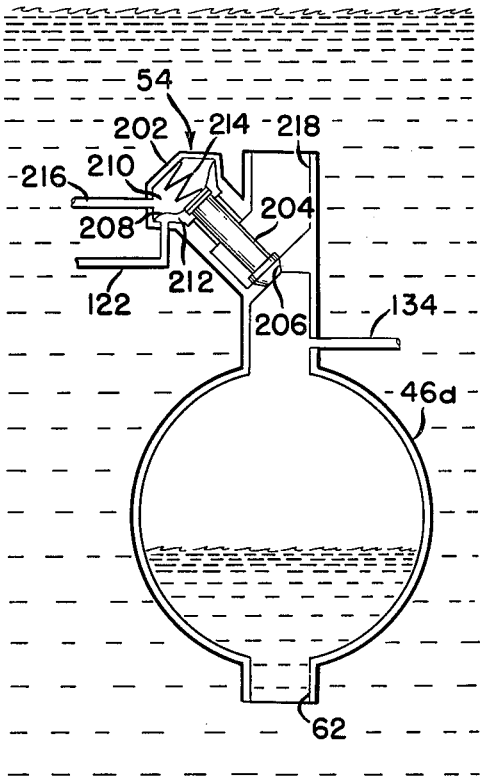
FIG. 8 is a schematic illustration of a valve for flooding or blowing various ballast tanks of the submersible barge.

A ballast flood valve 54, which is an air spring valve, for one of the portions of a main ballast tank is illustrated in FIG. 8. This is the configuration of any one of the main ballast flood valves 54, 55, 56, 57, 58, 59, 60, or 61 or the trim ballast flood valves 84, 86, 88, or 90. Air spring valve 54 has a housing 202 which is mounted to and is in communication with the respective main ballast tank portion 46*a*. Slidably mounted within the housing 202 is a piston 204 which has a seat 206 for opening and closing the housing to the interior of the main ballast tank portion 46*a*. The other end of the piston 204 is provided with a diaphram 208 which bridges across the housing dividing the housing into a pair of compartments 210 and 212. Interconnected into the bottom compartment 212 of the housing is one of the control air pressure lines, such as line 122. The top compartment 210 is provided with a spring 214 for biasing the piston downwardly to close the seat 206. A spring assist is provided by an air pressure line 216 into compartment 210, which line will be described in more detail hereinafter. When control air pressure is applied through line 122, such as when flood valve 120 is pushed, the air pressure in compartment 210 and the biasing force of the spring 214 is overcome so that the piston 204 is pushed upwardly and the seat 206 opens the top of the ballast tank portion 46*a*. This then causes air within the tank 46*a* to vent through a top opening 218 of the tank resulting in seawater entering the bottom opening 62 of the tank and a consequent flooding thereof. The valve configuration illustrated in FIG. 8 is the same for each of the main ballast valves 54, 55, 56, 57, 58, 59, 60, 61 and the trim tank valves 84, 86, 88, and 90.

Figure 9C:
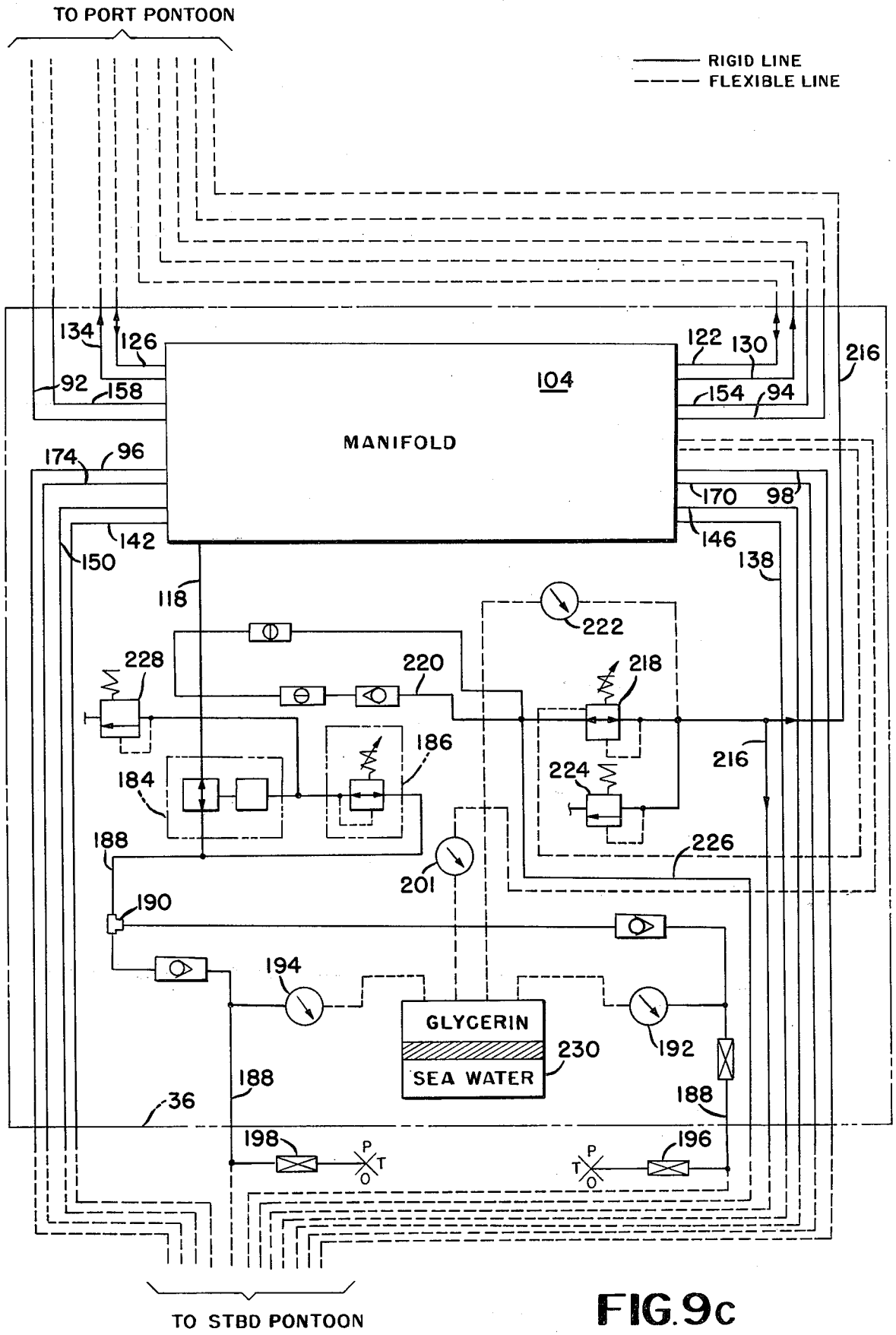

The air pressure for the spring assist to each of the air spring valves described in the preceding paragraph is commonly provided to all of these valves by air line 216 (see FIGS. 9*a*, 9*b*, and 9*c*). This line is located exteriorly of the manifold 104 and is regulated in its pressure by a regulator 218. The regulator 218 receives its high pressure air source from the main pressure regulator 184 via a line 220 and reduces this pressure to a suitable level, such as 40 psi. The air spring pressure can be read on the console by the gauge 222. The air spring system may be provided with a relief by relief valve 224.

The main pressure regulator 184 may be connected to the pair of air spring accumulators 20 and 22 via a line 226. These accumulators, which may consist of the entire volume of the outer pair of cross tubes will provide an adequate reserve air supply to resurface in the event of a main air supply failure or exhaustion. Relief for the regulated air from the regulator 184 may be provided by a relief valve 228. Pressure compensation for all of the various gauges may be provided by a glycerin and seawater pressure compensator 230.

OPERATION OF THE INVENTION

In the operation of the invention the barge 10 may either be towed in a surface or submerged condition aft of the surface craft 12. During this transit phase, the underwater vehicle 14 may be lashed down to the grating 27 of the submersible barge. Once the barge has reached the operational site, a diver sits on the seat 34 facing the console 36 and operates the various joy sticks 38, 40, 42 and 44 for placing the barge in a desired submerged condition for launching the underwater vehicle 14. Because of the unique quadrant control of the main ballast tanks 46, 48, 50, and 52 the diver can quickly obtain an approximate desired ballasting condition of the barge. After this is attained the diver can control the barge with the trim tank quadrant control by utilizing the inner joy sticks 42 and 44 for controlling the trim tanks 76, 78, 80, and 82. By utilizing his natural psychological instincts the barge will roll and pitch in the direction in which a joy stick is pushed, and will quickly ascend or descend when the joy sticks are pushed inwardly or outwardly respectively. When the proper launching depth of the barge is obtained, the underwater vehicle 14 can be unlashed from the barge and released for its designated mission. The return of the underwater vehicle 14 to the barge is illustrated in FIG. 1 in which, upon landing on the barge, the underwater vehicle will once again be lashed down and secured. When the mission has been completed the barge and underwater vehicle will be towed back to port.

Obviously, many modifications and variations of the present invention are possible in the light of the above teachings, and, it is therefore understood that within the scope of the disclosed inventive concept, the invention may be practiced otherwise than specifically described.

What is claimed is:

1. A control system for a submersible barge which has starboard bow, port bow, starboard stern, and port stern quadrants, said control system comprising:

said barge having starboard and port pontoons which are each divided into forward and aft ballast tanks;

ballasting and deballasting means for selectively flooding or blowing each of said ballast tanks so as to move any of the barge quadrants in a downward or an upward inclination;

means, including a pair of joy sticks, for selectively actuating the ballasting and deballasting means;

said joy sticks each having bow, stern, starboard and port directional movements and diagonal directional movements between each of the starboard and bow, port and bow, starboard and stern, and port and stern pairs of directional movements so as to constitute a total of eight available directions of movements;

the joy sticks being mounted with their bow, stern, starboard, and port directions corresponding to the bow, stern, starboard, and port portions of said barge;

the actuating means interconnecting the joy sticks with the ballasting and deballasting means for inclining the barge in the direction of movement of the respective joy stick in any of said eight available directions of movement.

2. A control system as claimed in claim 1 including:

one joy stick being mounted on starboard portion of the barge and the other stick being mounted on a port portion of the barge;

the actuating means interconnecting the starboard joy stick with the ballasting and deballasting means for selectively flooding or blowing only the forward and aft ballast tanks of the starboard pontoon and interconnecting the port joy stick with the ballasting and deballasting means for selectively flooding or blowing only the forward and aft ballast tanks of the port pontoon.

3. A control system as claimed in claim 2 including:

the actuating means interconnecting the joy sticks with the ballasting and deballasting means for blowing the bow ballast tank and flooding the stern ballast tank when the respective joy stick is moved in the stern direction, blowing the stern ballast tank and flooding the bow ballast tank when the respective joy stick is moved in a bow direction, blowing both the bow and stern ballast tanks when the respective joy stick is moved inwardly and flooding both the bow and stern ballast tanks when the respective joy stick is moved outwardly.

4. A control system as claimed in claim 3 including:

the actuating means interconnecting the starboard joy stick with the ballasting and deballasting means for flooding and blowing the starboard bow ballast tank when the starboard joy stick is moved in the starboard bow and port stern diagonal directions respectively and for blowing and flooding the starboard stern ballast tank when the starboard joy stick is moved in the port bow and starboard stern diagonal directions respectively; and the actuating means interconnecting the port joy stick with the ballasting and deballasting means for flooding and blowing the port bow ballast tank when the port joy stick is moved in the port bow and starboard stern diagonal directions respectively, and for blowing and flooding the port stern ballast tank when the port joy stick is moved in the starboard bow and port stern diagonal directions respectively.

5. A control system as claimed in claim 4 including:

said barge having a second set of starboard bow, port bow, starboard stern, and port stern ballast tanks which have less volume and are mounted above the first mentioned set of ballast tanks;

a second pair of joy sticks mounted on the barge between the first pair of joy sticks with one joy stick of the second pair being located in a starboard portion of the barge and the other joy stick of the second pair being located in a port portion of the barge; and the actuating means interconnecting the second pair of joy sticks with the ballasting and deballasting means for flooding and blowing the second set of ballast tanks in the same pattern as the first mentioned set of ballast tanks when the second pair of joy sticks are moved in the same directions as the first pair of joy sticks.

6. A control system as claimed in claim 5 including:

the actuating means including a manifold block;

each joystick being mounted by a ball and socket joint to the manifold block;

a pushbutton valve mounted in the manifold block radially spaced from the ball and socket joint in the direction of actuating diagonal movement of each respective joy stick; and a swash plate laterally mounted to each respective joy stick for pushing the pushbutton valves when the joy stick is moved in various directions.

7. A submersible barge comprising:

said barge having a ballast tank at each quadrant so as to provide starboard bow, starboard stern, port bow, and port stern ballast tanks;

ballasting and deballasting means for flooding or blowing each ballast tank;

actuating means including a pair of starboard and port joy sticks mounted on the barge in an aligned athwartships direction;

each joy stick having at least four degrees of freedom in diagonal directions between bow, stern, starboard, and port;

said actuating means interconnecting the starboard joy stick with the ballasting and deballasting means so that the starboard joy stick floods the starboard bow and starboard stern ballast tanks when the starboard joy stick is pushed in the starboard bow and starboard stern diagonal directions respectively and blows te starboard bow and starboard stern ballast tank when the starboard joy stick is pushed in the port stern and port bow diagonal directions respectively;

said actuating means interconnecting the port joy stick with the ballasting and deballasting means so that the port joy stick floods the port bow and port stern ballast tanks when the port joy stick is pushed in the port bow and port stern diagonal directions respectively and blows the port bow and port stern ballast tanks when the port joy stick is pushed in the starboard stern and starboard bow diagonal directions respectively.

8. A submersible barge as claimed in claim 7 includes;

each joy stick having four additional degrees of freedom is bow, stern, starboard and port directions;

said actuating means interconnecting the starboard joy stick with the ballasting and deballasting means so that the starboard bow ballast tank is flooded and the starboard stern ballast tank is blown simultaneously when the starboard joy stick is pushed in the bow direction, the starboard stern ballast tank is flooded and the starboard bow ballast tank is blown simultaneously when the starboard joy stick is pushed in the stern direction, the starboard bow and starboard stern ballast tanks are flooded simultaneously when the starboard joy stick is pushed in the starboard direction, and the starboard bow and starboard stern ballast tanks are blown simultaneously when the starboard joy stick is pushed in the port direction;

said actuating means interconnecting the port joy stick with the ballasting and deballasting means so that the port bow ballast tank is flooded and the port stern ballast tank is blown simultaneously when the port joy stick is pushed in the bow direction, the port stern ballast tank is flooded and the port bow ballast tank is blown simultaneously when the port joy stick is pushed in the stern direction, the port bow and the port stern ballast tanks are flooded simultaneously when the port joy stick is pushed in the port direction, and the port bow and port stern ballast tanks are blown simultaneously when the port joy stick is pushed in the starboard direction.

9. A submersible barge as claimed in claim 8 including;

metering means connected to the ballasting and deballasting means for ballasting and deballasting the ballast tanks to effect substantially a zero change in overall buoyancy of the barge when either the starboard or port joy sticks are pushed in either a bow or stern direction.

10. A control system for a submersible barge which has starboard bow, port bow, starboard stern, and port stern quadrants, said control system comprising:

said barge having starboard and port pontoons which are each divided into forward and aft ballast tanks;

ballasting and deballasting means for selectively flooding or blowing each of said ballast tanks so as to move any of the barge quadrants in a downward or an upward inclination;

means, including a pair of joy sticks, for selectively actuating the ballasting and deballasting means;

said joy sticks each having bow, stern, starboard and port directional movements and diagonal directional movements between each of the starboard and bow, port and bow, starboard and stern, and port and stern pairs of directional movements so as to constitute a total of eight available directions of movements;

the joy sticks being mounted with their bow, stern, starboard, and port directions corresponding to the bow, stern, starboard, and port portions of said barge;

the actuating means interconnecting the joy sticks with the ballasting and deballasting means for inclining the barge inthe direction of movement of the respective joy stick in any of said eight available directions of movement;

the actuating means including a manifold block;

each joy stick being mounted by a ball and socket joint to the manifold block;

a push button valve mounted in the manifold block radially spaced from the ball and socket joint in the direction of actuating diagonal movement of each respective joy stick; and a swash plate laterally mounted to each respective joy stick for pushing the push button valves when the joy stick is moved in various directions.

* * * * *